United States Patent [19]

Auer, Jr.

[11] 4,093,161

[45] June 6, 1978

[54] CONTROL SYSTEM WITH IMPROVED COMMUNICATION FOR CENTRALIZED CONTROL OF VEHICLES

[75] Inventor: John H. Auer, Jr., Fairport, N.Y.

[73] Assignee: General Signal Corporation, Rochester, N.Y.

[21] Appl. No.: 790,737

[22] Filed: Apr. 25, 1977

[51] Int. Cl.[2] ..... B61L 27/00

[52] U.S. Cl. ..... 246/5; 364/436; 246/187 B; 246/187 A

[58] Field of Search ..... 246/3, 4, 5, 63 C, 187 A, 246/187 B; 340/146.1 C, 155, 163; 235/150.24

[56] References Cited

U.S. PATENT DOCUMENTS

| | | | |
|---|---|---|---|
| 3,268,727 | 8/1966 | Shepard | 246/187 B |
| 3,794,833 | 2/1974 | Blazek | 246/187 B |
| 3,819,932 | 6/1974 | Auer, Jr. | 246/187 B |
| 3,964,702 | 6/1976 | Lardennois | 235/150.24 |

*Primary Examiner*—Trygve M. Blix
*Assistant Examiner*—Reinhard J. Eisenzopf
*Attorney, Agent, or Firm*—Pollock, Vande Sande & Priddy

[57] ABSTRACT

A control system for a plurality of vehicles provides for efficient communication while minimizing necessary bandwidth and communication delays. Periodic reports are received from the vehicles by a controlling authority. All vehicles in motion continually receive a permissive GO signal. When the controlling authority determines a vehicle should be stopped, it immediately addresses a STOP command thereto. The addressed vehicle acknowledges the message. Failure of the controlling authority to receive the acknowledgement results in removal of the permissive GO, stopping all vehicles.

8 Claims, 3 Drawing Figures

FIG. 1
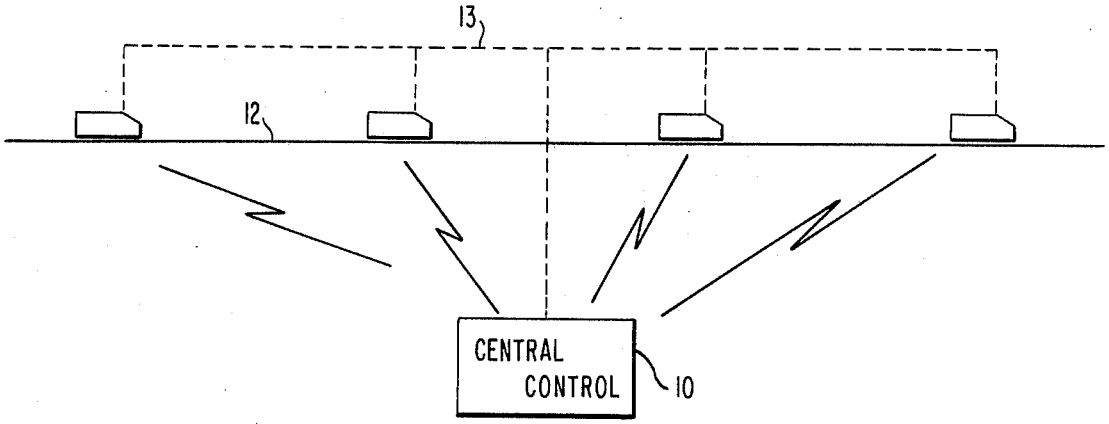
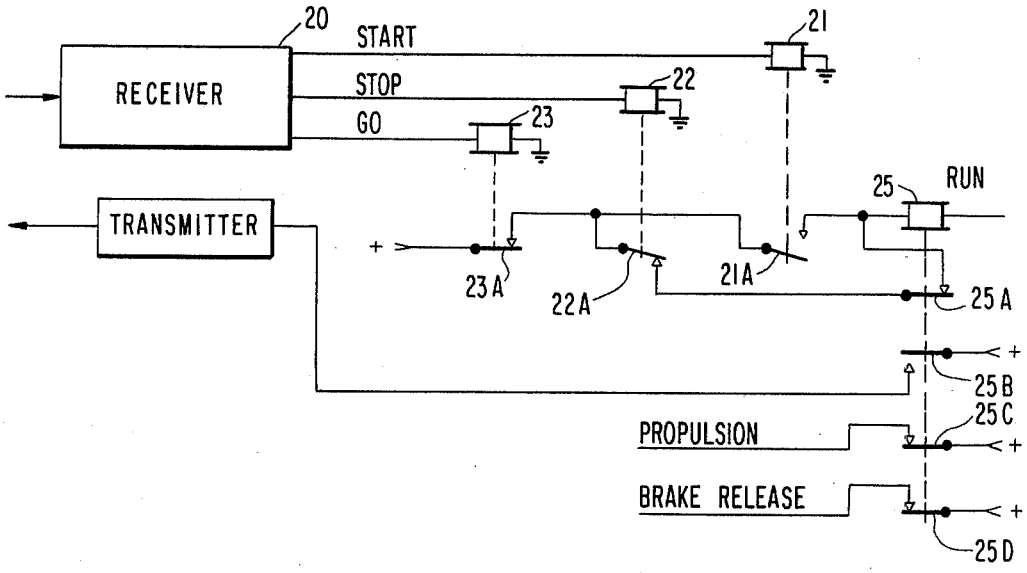
FIG. 2

CONTROL SYSTEM WITH IMPROVED COMMUNICATION FOR CENTRALIZED CONTROL OF VEHICLES

FIELD OF THE INVENTION

The invention relates to the remote control of vehicles.

BACKGROUND OF THE INVENTION

Vehicle control systems are known to the art which are characterized by a centralized controlling authority which receives information from the vehicles within its zone of control, and in which the controlling authority transmits signals for the purpose of safely controlling the travel of the vehicles. Essential to any such system is, of course, an effective communication system, for it is only through the communication system that the controlling authority can determine vehicle location and speed, and it is only through such facility that the controlling authority's commands can be communicated to the vehicles for purposes of controlling their travel. Examples of control systems of this sort in which the vehicles are railroad vehicles and the controlling authority includes a computer or computer complex are found in U.S. Pat. Nos. 3,268,727; 3,819,932; and 3,794,834.

Typically required in a practical system is the capability for the controlling authority, and its attendant communication channels, to handle approximately 40 vehicles simultaneously. The communication to and from these vehicles can be handled on a time multiplexed basis in which the controlling authority periodically transmits a message to each of the vehicles within its control zone, and reception of the message aboard the vehicle generates a reply message from the vehicle. As will be apparent to those skilled in the art, the length of the communication cycle may have a substantial impact on the minimum vehicle headway. For example, in a practical situation, the communication cycle may be on the order of ½ second. Because of this, if the controlling authority determines that motion by a particular vehicle should be terminated, it can be up to ½ second before that command may be communicated to the vehicle. As a backup for the communication system, the vehicles normally carry a timer which is reset upon each receipt of a message from the controlling authority so that if a communication channel fails, the vehicle will be automatically stopped. Because of difficulties in designing fail-safe timers with precise timing periods, it may be up to a full second after the controlling authority determines a vehicle is to be stopped, before the vehicle enters the stopping mode. These considerations obviously bear upon minimum system headway.

Attempts to decrease the communication cycle time require corresponding increase in communication bandwidth or decrease in the amount of information to be communicated.

It is therefore one object of the present invention to decrease control system delays caused by the communication system. It is another object of the present invention to minimize the bandwidth required for communications by such a control system.

It is another object of the invention to facilitate communications in such system by removing unnecessary communication.

SUMMARY OF THE INVENTION

These and other objects of the invention are met by method and apparatus of this invention. In accordance with the invention, all vehicles in motion continuously receive the permissive GO signal, enabling them to proceed. Since the GO signal is provided in common, or on a party line basis to all vehicles, minimum communication bandwidth is required. Communication delays in transmitting a STOP command are minimized by transmitting that command as soon as it is generated. To provide fail-safe attributes in the reception of the STOP command, each vehicle on reception of such command, transmits back to the controlling authority an acknowledgement of the command. Failure by the controlling authority to receive the STOP command acknowledgement is effective to remove the permissive GO signal from all vehicles.

BRIEF DESCRIPTION OF DRAWINGS

The present invention will now be described in further detail with reference to the attached drawings in which:

FIG. 1 is a block diagram of a typical system; and

FIG. 2 is a schematic diagram of typical vehicle carried apparatus in accordance with the present invention.

DETAILED DESCRIPTION OF THE INVENTION

FIG. 1 is a block diagram of a typical vehicle control system in which a centralized authority receives reports from vehicles, and controls the vehicles by messages directed to the vehicles in accordance with the data determined from the vehicle reports. More particularly, a central control 10 is shown in FIG. 1 as communicating with a plurality of railroad vehicles travelling on a serial guideway or path 12. The apparatus included in the central control 10 typically takes the form of a general purpose digital computer, see in this regard the patents cited above. Furthermore, the communications with the vehicles can be carried out in a variety of fashions, all known to those skilled in the art. Again, typically, some form of time multiplexed communication is employed, although those skilled in the art will appreciate that frequency multiplexing can also be employed. The operation of the system is cyclic in that the central control formulates a message for a vehicle, communicates the message to the vehicle, the vehicle responds to the message by carrying out any commands contained therein and formulates a reply to the central control which contains information as to the vehicle's position, velocity, route, etc. While the communication is cyclic, it can be initiated, in some systems, by the central control and in other systems by the vehicles, or it can be initiated on some periodic basis, either based on time, distance travelled or the like. Regardless of the parameters of any specific system, typical prior art systems require that in complying with the fail-safe requirements, a backup is provided. For example, if the communication is initiated based on elapsed time, the vehicle would carry a timer and if no communications were received in the period of time related to the expected communication cycle, the vehicle assumed a communication failure had occurred and stopped. Thus, the central control 10, in order to keep the vehicles in motion, is required to periodically transmit a message to the vehicle that it could proceed. Furthermore, since the condition of each vehicle may be different, the central control 10 had to respond to each different vehicle's condition, including the condition of vehicles nearby, before formulating and transmitting the signal to the vehicle, permitting it to continue to travel. Thus, each of the vehicles had to receive a command specific to it, allowing it to proceed, and such command had to be received within the time governed by the vehicle-carried timers in order for the system to operate effectively. The transmission of all these commands obviously requires bandwidth, and it is the reduction of this bandwidth to which the present invention is addressed.

In accordance with the present invention, the central control 10 makes available to each of the vehicles within its zone of control, on a party-line basis, a permissive GO command, exemplified by the dotted party-line 13 shown in FIG. 1. Since this is a party-line communication, one addressed to all vehicles, it obviously consumes minimum bandwidth. Indeed, even this minimum bandwidth can be dispensed with, and the permissive GO command required can be communicated to the vehicles by making power available to the vehicles, for example, such as by a third rail or the like. For safety purposes, the permissive GO command, exemplified by party-line 13, is effective only at those vehicles already in motion, and vehicles which are stopped must receive a specific start command, specific to them, before they can begin motion.

Typical vehicle-carried apparatus to implement the invention is illustrated in FIG. 2. FIG. 2 illustrates that each vehicle includes a receiver 20. The input to the receiver is via the communication channel from central control 10. The vehicle receiver 20 has a plurality of outputs. One output identified as START, is coupled to energize a detector, which, in FIG. 2, is exemplified by a relay 21.

The receiver 20 also has another output identified as STOP, and this is made available to a different detector on board the vehicle, exemplified in FIG. 2 by relay 22. Finally, in one embodiment of the invention, the receiver includes a third output identified as GO, made available to a separate detector on board the vehicle, exemplified in FIG. 2 by relay 23. Each vehicle also includes a transmitter 24 for the purposes of communicating information back to the central control 10.

The detectors thus far identified cooperate as follows. A run relay 25 is included on board each vehicle, and the vehicle cannot proceed unless the run relay is energized. A number of paths are provided to energize the run relay. One energization path is coupled from a positive source of potential over a front contact 23A of relay 23 through a front contact 21A of relay 21, to the run relay. A second energization path for the run relay 25 branches off from the foregoing path after the front contact 23A and includes a back contact 22A of relay 22, and a front contact 25A of the run relay 25. This apparatus provides that a stopped vehicle can be put in motion by energization of relays 23 and 21. Clearly, therefore, the GO command, energizing relay 23, is insufficient to start in motion a vehicle that is stopped. However, once the vehicle is in motion, front contact 25A is closed, and the vehicle will continue in motion so long as the GO command is received and the stop command is not received. With the run relay 25 energized, front contacts 25C and 25D are closed providing energy to propulsion equipment and providing further energy to maintain the brakes released.

Assume that a vehicle in motion now receives a STOP command. Stop relay 22 is energized, and since start relay is de-energized, the run relay 25 is de-energized. De-energization of the run relay opens all its front contacts 25A, 25C and 25D, and closes its back contact 25B to energize transmitter 24 to communicate a message back to the central control 10, that the vehicle is in the stopping mode. This message serves to acknowledge receipt of the STOP command. If, after sending a stop command to a specific vehicle, the central control does not receive the vehicle's acknowledgement that it is not running, then the central control removes the permissive party-line GO signal, causing each of the vehicles of the system to stop. Referring again to FIG. 2, removal of the party-line GO signal implies, at the vehicle, de-energization of relay 23, which, as will be apparent to those skilled in the art, immediately causes the run relay 25 to release. This will be effective to stop the vehicle, and since this action will occur in each of the vehicles when the party-line GO signal is removed, each of the vehicles will be stopped.

In practical systems, of course, the receiver 20 and transmitter 24 will have functions other than that shown in FIG. 2. However, these functions are not related to the specific functions carried out in accordance with the principles of the invention, and thus are not illustrated.

Those skilled in the art will appreciate that many variations can be made to the method and apparatus of the invention disclosed herein. For example, as mentioned previously, the receiver 20 need not provide a specific GO output. As one alternative, the permissive GO can be communicated to each of the vehicles by making power available to the vehicle, and removing the power will cause each of the vehicles to stop. Furthermore, although I show relays in FIG. 2, those skilled in the art will understand that other types of detectors can be employed within the spirit and scope of the invention.

What is claimed is:

1. A method of operating a plurality of vehicles controlled by a central controlling authority and communicating with the vehicles over a communication facility including the steps of:

(a) manifesting to all vehicles within a common zone of control a permissive GO indication;

(b) communicating information from a plurality of vehicles to a central controlling authority and determining, at said central controlling authority, whether said vehicles or any of them should continue in motion;

(c) for each vehicle it is determined should not continue in motion, formulating and communicating to such specific vehicle a STOP command;

(d) receiving said STOP command aboard said specific vehicle and transmitting to said central controlling authority a manifestation that said STOP command has been received; and, (e) removing said permissive GO indication from each of the vehicles if said central controlling authority does not receive said acknowledgement that said stop command has been received from each vehicle to which a STOP command was transmitted.

2. The method of claim 1 wherein said step (a) includes simultaneously transmitting said permissive GO indication to all said vehicles.

3. The method of claim 1 wherein said permissive GO indication is manifested by making power available to all said vehicles.

4. A control system for the control of a plurality of vehicles travelling on a guideway comprising:

means for communicating a first signal to all vehicles on said guideway from a central location, each of said vehicles including means responsive to said first signal to maintain motion, if said vehicle was in motion, means at said central location for communicating a second signal to a vehicle on said guideway, said second signal, when received on said vehicle, preventing further motion thereof, vehicle carried transmitter means responsive to receipt of said second signal for transmitting a third signal, and means at said central location responsive to receipt of said third signal to enable continued communication of said first signal, and responsive to absence of receipt of said third signal, for disabling said first signal.

5. The apparatus of claim 4 wherein said means for communicating a first signal simultaneously communicates said said first signal to all said vehicles.

6. The apparatus of claim 5 wherein said means for communicating includes power supply means to supply operating power to all said vehicles.

7. The apparatus of claim 5 wherein said vehicles include, a run control device with two conditions, in one condition said run control device allows vehicle motion and in another condition prevents vehicle motion, said means for communicating a second signal includes, onboard said vehicle, means responsive to said second signal for operating said run control device to said another condition.

8. The apparatus of claim 7 which further includes, means for communicating a fourth signal to a vehicle on said guideway, means aboard said vehicles responsive to reception of said fourth signal for operating said run control device to said one condition if said vehicle is also receiving said first signal.

* * * * *